United States Patent [19]

Winn et al.

[11] 3,959,529

[45] May 25, 1976

[54] WOOD TREATING PROCESS

[75] Inventors: William D. Winn; Johnney T. Pollan, both of Lake Jackson, Tex.

[73] Assignee: The Dow Chemical Company, Midland, Mich.

[22] Filed: June 14, 1974

[21] Appl. No.: 479,239

[52] U.S. Cl. ..... 427/335; 8/6.5; 21/7; 34/9.5; 34/13.8; 34/16.5; 252/380; 252/387; 427/351; 427/370

[51] Int. Cl.[2] ..... B27K 3/08; B27K 3/40

[58] Field of Search ..... 144/271; 134/11, 30; 21/7; 117/63, 147, 149; 427/335, 351, 370; 8/6.5; 34/9.5, 13.8, 16.5; 252/380, 387

[56] References Cited

UNITED STATES PATENTS

| | | | |
|---|---|---|---|
| 2,650,885 | 9/1953 | Hudson | 117/147 X |
| 2,860,070 | 11/1958 | McDonald | 117/59 |
| 2,867,543 | 1/1959 | Braun | 117/46 |
| 3,200,003 | 8/1965 | Beichen | 117/59 |
| 3,369,965 | 2/1968 | Gilbert | 21/7 X |
| 3,685,959 | 8/1972 | Dunn et al. | 21/7 |
| 3,840,388 | 10/1974 | Perlus | 117/63 |

FOREIGN PATENTS OR APPLICATIONS

| | | |
|---|---|---|
| 519,730 | 12/1955 | Canada |

*Primary Examiner*—Michael R. Lusignan
*Attorney, Agent, or Firm*—Glywnn R. Baker

[57] ABSTRACT

A method for producing clean surface treated wood by subjecting the wood, containing the treating agent and its carrier, to steaming under pressure thereby to cause the solvent in the atmosphere about the wood to condense on the wood surface during the steaming, thereafter reducing the pressure to about atmospheric pressure, removing the carrier vapors from association with the wood as they form, and continuing the steaming until the carrier is substantially removed from the wood.

2 Claims, No Drawings

WOOD TREATING PROCESS

BACKGROUND OF INVENTION

The treatment of wood and wood products to impart one or more desirable properties to the wood, such as resistance to microbial attack, by impregnation of the wood with a treating agent dissolved in a carrier is an old and well established art. Many wood products for use in industrial applications have been impregnated with a petroleum oil as the carrier for the agents. Water has been employed as the carrier for water soluble copper salts and organic solvents such as methylene chloride and liquid petroleum gases have been employed as carriers for many agents. The use of water and organic solvents has become more widely employed in recent years as the power companies have gone to natural appearing poles and poles that can be painted. Similarly dimensional lumber has been treated with agents from water and organic solvents as in many situations paint or other finishes are desirably applied. However, each of these latter treatments suffers from the disadvantages that as the water or solvent (carrier) is removed from the wood the treating agent and wood exudates are brought to the surface. These surface deposits have conventionally been removed by brushing the wood after treatment. It would therefore be advantageous if a process could be provided which would not require the after-treatment brushing.

BRIEF DESCRIPTION OF INVENTION

In accordance with the present invention wood is impregnated with a carrier containing the treating agent or agents by immersing the wood in the carrier-agent in a pressure cylinder and applying pressure to cause the desired penetration of the carrier-agent into the wood. Following impregnation the cylinder is drained of carrier-agent which has not entered the wood and carrier removal from the wood is commenced. In a preferred embodiment of the present invention carrier (solvent) removal is accomplished by subjecting the impregnated wood to steam under superatmospheric pressure up to 100 psig and temperatures up to 240°F (ca 115.5°C). The steam and its attendant carrier vapors are vented at such a rate that the carrier vapors build-up in the cylinder to a sufficient quantity that under the pressure within the cylinder carrier vapors condense on the wood surface flushing the surface free of crystalline agent and wood exudates. When a major portion of the solvent retained in the wood has been removed in this manner, the cylinder is vented to atmospheric pressure and steaming continued to obtain removal of the remainder of the solvent in the cylinder. The cylinder is then ready to open to the atmosphere. The wood removed after this treatment is clean, free of agent at the surface and has the natural appearance (color) of wood.

It is to be understood that other carriers volatile at below 240°F (115.5°C) may be employed, including water. Best results have been obtained when methylene chloride is the carrier.

Substantially any treating agent can be employed which is soluble in the carrier. For example, antimicrobial agents such as polychlorinated phenols, particularly pentachlorophenol, fire retardant chemicals, bulking agents, dimensional stabilizers, and the like. Dyes may also be employed either alone or in combination with one or more of the aforementioned agents.

The pressure impregnation is advantageously conducted at ambient temperature to about 40°C (104°F) under superatmospheric pressures up to about 150 psig (ca 10 atm.) for from ¼ to about 8 hours. The steaming and solvent recovery cycle of the present invention is advantageously carried out at temperatures of from about 100°C (212°F) to about 240°F (115.5°C) under superatmospheric pressures up to about 100 psig for from about 2 to about 16 hours.

The steps of the process of the present invention are broadly set forth below:

1. Charge cylinder with wood products are seal cylinder.
2. Fill cylinder with treating solution.
3. Apply pressure to treating solution to cause required amount of solution to enter wood.
4. Release pressure and drain cylinder without permitting air to enter cylinder.
5. Introduce steam into cylinder or introduce water into cylinder and activate heating coils in bottom of cylinder to heat water to generate steam in cylinder, to heat cylinder and contents and produce a pressure above atmospheric pressure thereby to cause the carrier vapor or at least a part of it to condense on the wood during the heating of the wood. (The wood will not achieve the temperature of the surrounding atmosphere until the major portion of the carrier has been removed from the wood).
6. Vent the cylinder once it is at the desired pressure to remove excess vapors resulting from the solvent being vaporized from the wood.
7. Lower the pressure in the cylinder to atmospheric when the cylinder vapor temperature reaches the desired temperature, not higher than 240°F (115.5°C).
8. Continue steaming at atmospheric pressure to remove carrier (solvent) vapors from cylinder.
9. Cool cylinder, drain cylinder condensate, open to atmosphere and remove wood.

These steps differ from example from those described in U.S. Pat. No. 3,685,959 in that the steaming of the wood after impregnation is done under pressure to insure the solvent vapors will condense on the wood during the early stages of solvent removal to wash the wood surface free of preservative and wood exudates brought to the surface during the removal of the solvent. The accummulation of preservative and wood exudates are found to occur during the early stages of the solvent recovery from the wood nearest the surface. It appears that after these materials are brought to the surface, there is an equilibration from the interior and less material is brought to the surface as the solvent content of the wood is reduced. Thus, the present invention provides major washing during the initial stages of solvent removal and lesser washing as the system heats up and the final vestiges of solvent are being removed.

In a representative example employing the steps above, wood was found to be substantially free of wood preservative, in this case pentachlorophenol, and wood exudates. In a comparative example wherein steaming was carried out at atmospheric pressure it resulted in the surface of the treated wood having an accumulation of pentachlorophenol whiskers and wood exudate which require brushing prior to use.

What is claimed is:

1. In a method for treating wood by impregnation with one or more wood treating agents selected from the group antimicrobials, fire retardants, bulking agents, dimensional stabilizers, and coloring agents, wherein the treating is accomplished by a pressure impregnation with a solution of the wood treating agent(s) in a volatile water-immiscible low boiling organic solvent and recovery of the solvent is accomplished by steaming after impregnation, the improvement which consists of maintaining during steaming a solvent rich atmosphere in contact with the wood, thereby to condense solvent on the surface of the wood to wash the surface free of treating agent and wood exudates.

2. A method for removing surface deposits from solvent-antimicrobial pressure treated wood during the solvent removal step by maintaining solvent vapor content of the steam by adjusting the solvent content of the atmosphere in the cylinder through increase in pressure so that some solvent vapor will condense on the wood washing the surface thereby dissolving the antimicrobial and wood exudates brought to the surface by the solvent leaving the wood, and when the major portion of the solvent has been removed from the wood the solvent content of the atmosphere surrounding the wood is reduced by reducing the pressure to facilitate the removal of the remainder of the solvent.

* * * * *